United States Patent [19]

Tanaka et al.

[11] 4,183,123

[45] Jan. 15, 1980

[54] YARN TEXTURING APPARATUS

[75] Inventors: Kenzo Tanaka; Tetsuhiko Endō, both of Otsu, Japan

[73] Assignee: Toray Industries, Inc., Tokyo, Japan

[21] Appl. No.: 860,909

[22] Filed: Dec. 15, 1977

[30] Foreign Application Priority Data

Jun. 24, 1977 [JP] Japan ..... 52/74454

[51] Int. Cl.[2] ..... D02G 1/16

[52] U.S. Cl. ..... 28/273; 28/254

[58] Field of Search ..... 28/271, 272, 273, 254

[56] References Cited

U.S. PATENT DOCUMENTS

| | | | |
|---|---|---|---|
| 2,938,256 | 5/1960 | Bauer et al. | 28/271 |
| 3,103,731 | 9/1963 | Salyer et al. | 28/273 |
| 3,881,231 | 5/1975 | Price et al. | 28/254 |

FOREIGN PATENT DOCUMENTS 1172440 10/1958 France .

*Primary Examiner*—Robert Mackey
*Attorney, Agent, or Firm*—Miller & Prestia

[57] ABSTRACT

Disclosed is a yarn texturing apparatus for producing a multifilament yarn containing complex interfilament entanglement, comprising a housing having inlet and outlet ends connected by a yarn passage, a turbulence section in the yarn passage, an exit orifice constituting the yarn outlet and communicating with the turbulence section and means for introducing pressurized gas into the yarn passage, which is improved by providing a yarn guide for separating a multifilament yarn blown out of the exit orifice from blown gas while guiding the yarn along a guide surface of the yarn guide. The yarn guide is provided outside of the housing and in the proximity of the exit end of the orifice, in a condition such that the yarn guide does not cross the center-line of the exit orifice and the guide surface of the yarn guide faces the yarn outlet end surface of the housing.

9 Claims, 23 Drawing Figures

YARN TEXTURING APPARATUS

BACKGROUND OF THE INVENTION

1. Fields of the Invention

The invention relates to an improved yarn texturing apparatus for producing a multifilament yarn containing complex interfilament entanglement by subjecting a running multifilament yarn to an action of a high speed flow of a gas such as pressurized air or steam.

2. Description of Prior Art

Yarn texturing apparatus for producing a bulky yarn by subjecting a running yarn to an action of a high speed flow of a fluid are known, for example, from U.S. Pat. Nos. 2,994,938 and 3,545,057. Yarns produced by these known apparatus have, however, drawbacks such that the crimps, curls and loops imparted to the individual filaments are not satisfactorily fixed in the yarn and, thus, the yarn has a poor resistance to elongation. Therefore, the yarns can not give the desired bulkiness to fabrics obtained therefrom, since the crimps, curls and loops of the yarn are greatly degraded during the processing for the production of the fabrics, even if the yarn is handled under a relatively low tension. Further, according to the conventional apparatus, the production cost becomes high, since a large amount of fluid is inevitably consumed per unit production of the textured yarn and, also, the yarn texturing speed is relatively slow. In order to improve these drawbacks, there have been proposed apparatus wherein baffles of various types are located at a position opposite to the yarn outlet end of the orifice of a yarn texturing jet device, with the object of increasing the yarn texturing and improving the uniformity of the processing yarn, for example, in U.S. Pat. Nos. 3,881,231, 3,881,232, 3,835,510 and 4,041,583. However, these apparatus are still unsatisfactory because the above-mentioned poor resistance to elongation of the produced yarns can not be sufficiently improved.

SUMMARY OF THE INVENTION

It is the primary object of the present invention to provide a yarn texturing apparatus capable of producing a bulky yarn having excellent, high, stable bulkiness while preventing the above-mentioned drawbacks of the prior art.

In accordance with the present invention, there is provided, to attain the above-mentioned object, a yarn texturing apparatus for producing a multifilament yarn containing complex interfilament entanglement comprising a housing having inlet and outlet ends connected by a yarn passage, a turbulence section in the yarn passage, an exit orifice constituting the yarn outlet and communicating with the turbulence section and means for introducing pressurized gas into the yarn passage, whereby a multifilament yarn is subjected to an action of the turbulence of the pressurized gas in the turbulence section and, thereafter, is blown out of the exit orifice together with the pressurized gas, characterized in that a yarn guide for separating said blown filament yarn from said blown gas while guiding said yarn along a guide surface of said yarn guide is further provided, outside of said housing and in the proximity of the exit end of said exit orifice, in a condition such that said yarn guide does not cross the center-line of said exit orifice, said guide surface of said yarn guide facing the yarn outlet end surface of said housing.

BRIEF DESCRIPTION OF THE DRAWINGS

FIGS. 5A through 10A are front views of various types of yarn guides usable for the apparatus of the invention.

FIGS. 5B through 10B are cross-sectional views of the respective yarn guides shown in FIGS. 5A through 10A, along X-X' lines.

DESCRIPTION OF PREFERRED EMBODIMENTS

Figure 1:
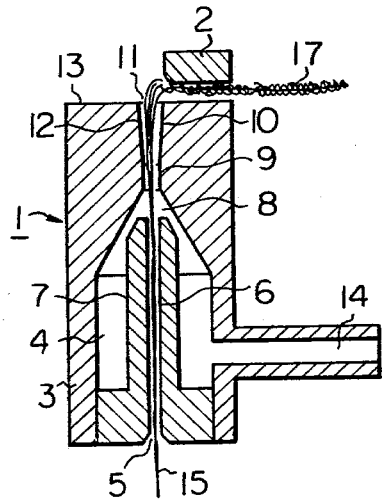
FIG. 1 is a cross-sectional view of an embodiment of the apparatus of the invention.
Figure 2:
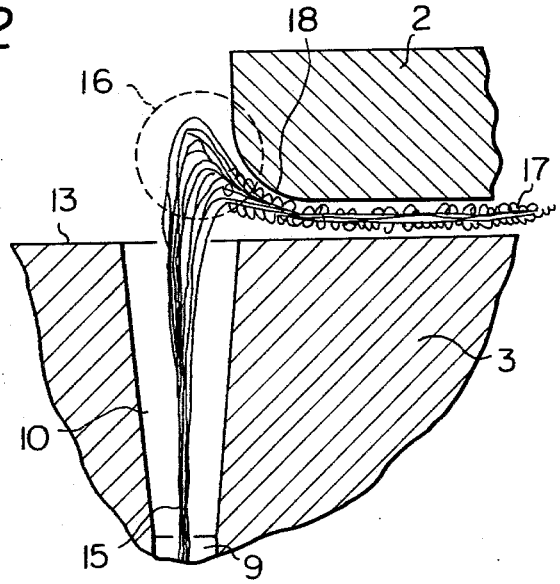
FIG. 2 is an enlarged cross-sectional view of the yarn outlet portion of the apparatus shown in FIG. 1.

Refering now to the drawings, the apparatus shown in FIGS. 1 and 2 includes a yarn texturing jet device 1 and a yarn guide 2. The jet device 1 has a housing 3 constituting the body thereof and having an expanded hollow portion 4 and an exit orifice 12 communicating with the hollow portion 4. Into the hollow portion 4, there is inserted a needle 7, having a yarn inlet 5 and an elongated axial channel 6 extending from the yarn inlet 5. The internal end of the needle 7 is positioned in a turbulence section 8 in an inwardly tapering conical shape provided on the entrance end of the exit orifice 12 and is fixed opposite to the entrance end of the exit orifice. The orifice 12 has a throat 9 having an axis approximately coincident to the axis of the elongated channel 6 of the needle 7 and a trumpet shaped passage 10. The exit end of the passage 10 is opened in the exit end surface 13 of the housing 3 and forms a yarn outlet 11. The hollow portion 4 of the housing 3 is communicated with a gas inlet pipe 14 for introducing a pressurized gas.

A yarn 15 fed from the yarn inlet 5 of the yarn texturing jet device is introduced into the turbulence section 8 through the elongated axial channel 6 of the needle 7. In the turbulence section 8, the yarn 15 is brought into contact with the gas introduced from the gas inlet pipe 14 and the individual filaments of the yarn 15 are separated from each other and deranged by the action of the flow gas. Then, the yarn is passed through the exit orifice 12 and blown out of the yarn outlet 11 together with the gas of a high speed flow.

The yarn blown with the gas of a high speed flow is drawn out from the flow gas in a direction approximately perpendicular to the flow direction of the gas, immediately after the yarn comes out of the yarn outlet 11. In the proximity of a bend 16, where the yarn changes its running direction, the yarn is subjected to vibration of a very short cycle and, thus, it is believed that loops, curls, entanglement and the like are imparted to the individual filaments of the yarn through the vibration so that the yarn becomes bulky. The yarn which becomes a bulky yarn 17 through the change of the running direction at the bend 16 and the formation of the loops and curls of the individual filaments, and of the interfilament entanglement and the like, is then, according to the present invention, advanced along a guide surface 18 of the yarn guide 2 and is delivered to a conventional take-up device (not shown).

It has now been found that the provision of the yarn guide 2, according to the present invention, in the proximity of the exit end of the yarn texturing jet device 1, can highly improve the resistance of the resulting yarn to elongation so that the bulkiness of the yarn is not lost during the processing for the production of fabrics. It is thus believed that, in the yarn texturing apparatus of the invention, as compared with the known apparatus as hereinbefore mentioned, more violent vibration of the yarn occurring at the bend 16 yields many more loops, curls and the like of the individual filaments and, concurrently, more complex and strong entanglement between the looped and curled filaments. This makes it possible to stably maintain the yielded bulkiness of the yarn.

Although only the texturing of a single yarn is described in the above, it is to be understood that so-called core and effect yarns can also be produced on the apparatus of the present invention.

It has also been found that the apparatus of the present invention makes it possible to save the pressurized gas necessary to produce a desired textured yarn.

Figure 3:
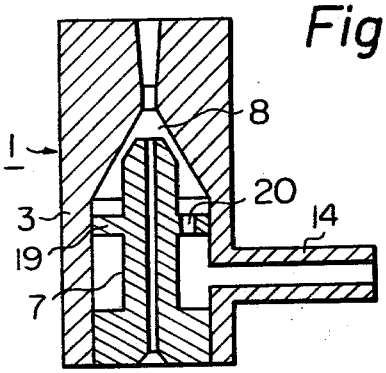
FIG. 3 is a cross-sectional view of another embodiment of the yarn texturing jet device usable for the apparatus of the invention.

The yarn texturing jet device as shown in FIG. 3 is provided, on the periphery of the needle 7, with a brim 19 having an opening 20 for introducing the gas into the turbulence section 8, so as to divide the hollow portion into two and to limit the flow of the gas fed from the gas inlet pipe 14 to the turbulence section 8. It will be appreciated that, in addition to the above, other types of jet devices may be employed in the apparatus of the present invention, provided that the jet devices have a construction such that a running yarn is subjected to an action of a high speed flow of a gas and is blown out together with the high speed flow gas.

Figure 4:
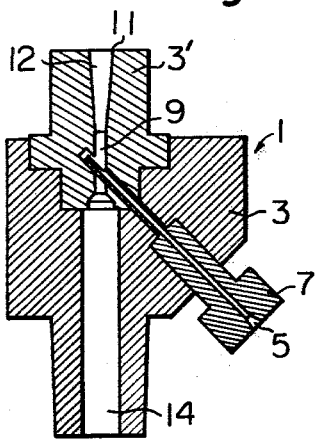
FIG. 4 is a cross-sectional view of a further embodiment of the yarn texturing jet device usable for the apparatus of the invention.
Figure 5A:
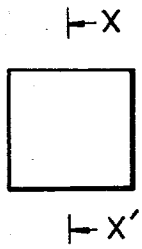
Figure 5B:
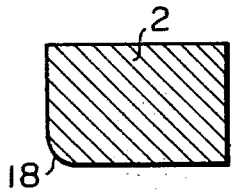
Figure 6A:
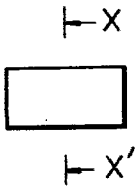
Figure 6B:
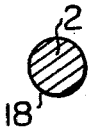

For example, a yarn texturing jet device as shown in FIG. 4 may further be employed in the apparatus of the present invention. Thus, in FIG. 4, the yarn texturing jet device 1 is composed of a housing 3, an orifice member 3' and needle 7 and is provided with a yarn inlet 5, a yarn outlet 11 and a gas inlet pipe 14. A yarn (not shown) introduced from the yarn inlet 5 of the needle 7 hits upon, at an angle of 45° to 60°, the turbulence flow of a gas fed from the gas inlet pipe 14, and then, is blown out of the yarn outlet 11 of the exit orifice 12 together with the flow gas.

Typical types of yarn guides advantageously usable for the apparatus of the present invention are shown in FIGS. 5A through 10A and 5B through 10B. FIGS. 5A through 10A illustrate the front views of the respective yarn guides and FIGS. 5B through 10B illustrate the cross-sectional views thereof along the X–X' lines shown in FIGS. 5A through 10A. The yarn guides shown in FIGS. 5A, 5B; 7A, 7B; 8A, 8B; and 10A, 10B are in a block shape and those shown in FIGS. 6A, 6B and 9A, 9B are in the shape of a pin having a circular cross-section. The guide surface 18 of each of the yarn guides shown in FIGS. 7A through 10A and 7B through 10B is provided on the bottom of a channel 21.

Figure 8A:
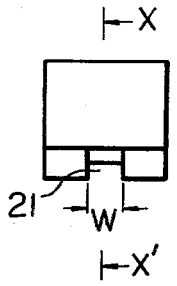
Figure 8B:
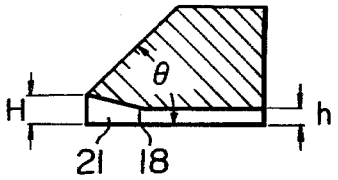

A construction of the yarn guide wherein the guide surface is formed on the bottom of a channel is preferred, since stable operation of the apparatus can be attained and, thus, a bulky yarn of a uniform quality can be obtained. Also, the use of a yarn guide of the type as shown in FIGS. 8A, 8B; 9A, 9B; or 10A, 10B is preferred, because the configuration, such as the size of the loops, of the resulting yarn becomes desirably uniform.

The material for constituting the guide surface 18 of the yarn guide 2 should be selected so as to pass the bulky yarn through the guide surface smoothly. If desired, the guide surface 18 may be subjected to surface treatment to improve the frictional and hardwearing properties thereof, or the guide surface may be exchangeably provided with a member made of a material having a good wear resistant property and low frictional characteristics, for example, a ceramic or super hard alloy material.

Figure 11:
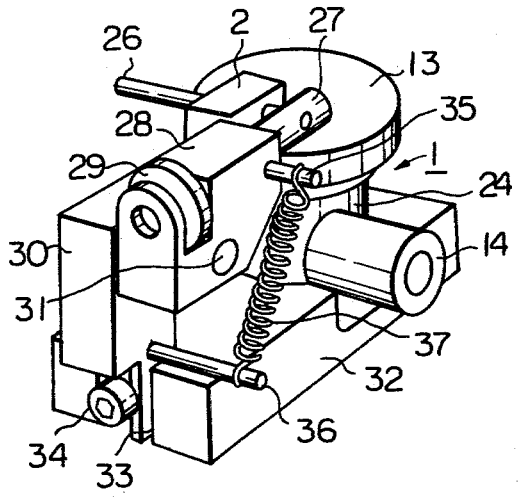
FIG. 11 is a perspective view of a preferred embodiment of the apparatus of the invention.
Figure 12:
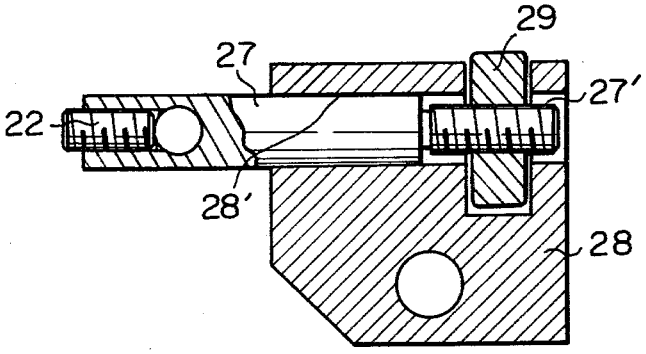
FIG. 12 is a cross-sectional view illustrating a mechanism for adjusting the position of the yarn guide provided on the apparatus shown in FIG. 11.
Figure 13:
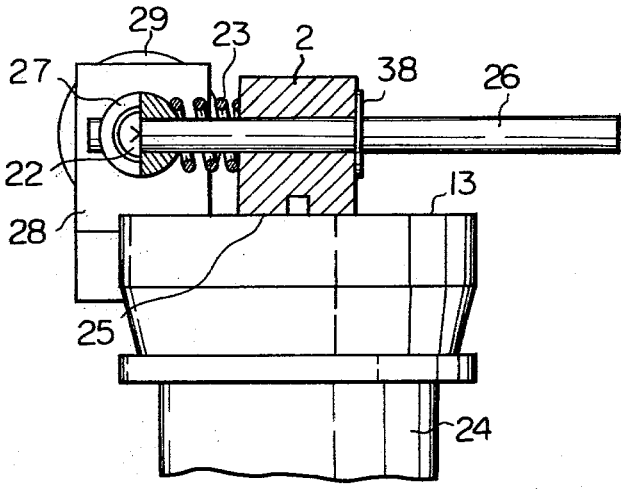
FIG. 13 is a front view of the apparatus shown in FIG. 11, partly in section, illustrating a mechanism for engaging the yarn guide with the apparatus.

In a preferred embodiment of the yarn texturing apparatus of the invention shown in FIGS. 11, 12 and 13, it is possible to adjust the position of the yarn guide 2. Referring now to FIGS. 11 and 12, a slide bar 27 is connected to a lever 26 to which the yarn guide 2 is secured. The slide bar 27 is slidable, in the longitudinal direction along a slide bore 28' formed in a rotational block 28, by means of a male screw 27' provided on the inner side end of the slide bar 27 and a female feed screw 29 engaged with the male screw 27'. The slide bar 27 does not rotate around the axis thereof. The rotational block 28 is pivotably secured to a pivot shaft 31 fixed to a slide block 30. The slide block 30 is slidable along a slide channel 33 formed in a base 32 fixed to the body 24 of the jet device 1 and is secured to the base 32 by a bolt 34. The rotational block 28 thus can be pivoted around the pivot shaft 31 in the direction of the yarn guide 2 moving away from the yarn outlet end surface 13 of the jet device 1, or vice versa, while being subjected to the action of a coil spring 37 set between a pin 35 secured to the rotational block 28 and a pin 36 secured to the slide block 30. In FIG. 11, 14 denotes the gas inlet pipe, as shown in FIGS. 1 and 3.

Referring to FIG. 13 in addition to FIG. 11, the yarn guide 2 is pivotably secured to the lever 26 and is suitably positioned, in the longitudinal direction of the lever 26, by a stop ring 38 stationarily secured to the lever and a compression spring 23 disposed between the yarn guide 2 and the slide bar 27. The position of the yarn guide 2 in the longitudinal direction of the lever 26 is adjustable by loosening a fixing screw 22 and moving the lever 26 along the axis thereof. After the yarn guide is desirably positioned, the fixing screw 22 is again tightened. Normally, the yarn guide 2 is pressed against the exit end surface 13 of the jet device 1 by the action of the coil spring 37, so that the bottom surface 25 of the yarn guide is brought into contact with the exit end surface 13 of the jet device. At the beginning of the operation, the yarn guide 2 is removed from the exit end surface 13, so that the yarn guide is positioned at a standby position, and thus, the threading operation can easily be carried out.

The invention will be further illustrated by the following illustrative, but non-limitative, examples.

EXAMPLE 1

Figure 7A:
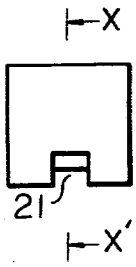
Figure 7B:
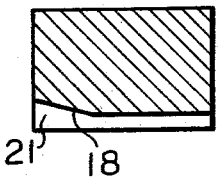

A yarn texturing jet device of the type as shown in FIG. 3 and a yarn guide of the type as shown in FIGS. 7A and 7B were employed. The diameter of the elongated axial channel 6 was 0.5 mm, that of the throat 9, 1.78 mm and that of the gas introducing opening 20, 2.78 mm. The channel 21 of the yarn guide was 1.0 mm in width and 0.5 mm in depth.

Figure 14:
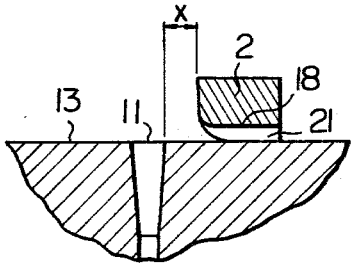
FIG. 14 and 15 schematically illustrate the relative positions of the yarn guide and the yarn outlet of the yarn texturing jet device.

As shown in FIG. 14, the yarn guide was located on the exit end surface 13 of the jet device in a condition such that one end of the yarn guide positioned opposite to the flow gas was at a distance of x mm from the periphery of the yarn outlet 11 of the jet device.

Using this apparatus, a polyester yarn of 150 denier/72 filaments was textured. The yarn which had been wetted with waterdrops was fed into the apparatus at a speed of 300 m/min through a feed roller and delivered by a delivery roller at a speed of 220 m/min. Pressurized air of 5 kg/cm$^2$ (G) was fed into the jet device through the gas inlet pipe. Then, the yarn was taken up on a take-up device at a speed of 247 m/min. The taking-up tension of the yarn being taken up was measured to determine the resistance to elongation of the resulting yarn.

Figure 16:
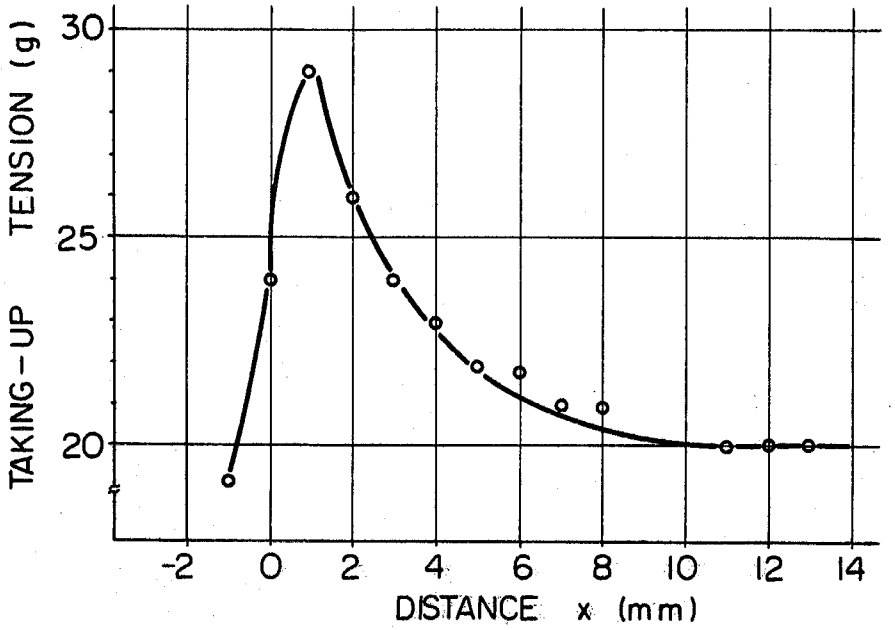
FIG. 16 is a graph showing the relationship between the taking-up tension of the resulting yarn and the position of the yarn guide.

The obtained relationship between the taking-up tension in grams and the distance x in mm are shown in the graph of FIG. 16. In the graph, the x of minus means that the upstream end of the yarn guide is positioned inside the periphery of the yarn outlet 11.

The taking-up tension of a yarn produced without the yarn guide was 20 grams. Where the x was smaller than −2 mm, the yarn texturing could not be carried out successfully.

EXAMPLE 2

The procedure as described in Example 1 was repeated, except that a yarn texturing jet device of the type as shown in FIG. 1 was employed, the distance x was 1 mm and the textured yarn was taken up at a speed of 242 m/min. The taking-up tension was 15 grams, while it was 10 grams in the case of using no yarn guide.

Where the yarn guide was not used, it was necessary, for obtaining a taking-up tension of 15 grams, to increase the taking-up speed up to 253 m/min.

EXAMPLE 3

Yarn textured according to the procedure as described in Example 2 and taken up under a taking-up tension of 15 grams was subjected to the measurement of the number of fuzzes per unit length using a photoelectric pick-up (made by Toray Industries Inc., Model DT-104). The number of fuzzes measured in this way is substantially proportional to the total number of crimps, curls and loops of the yarn. The number of fuzzes in the yarn obtained when no yarn guide was used is 80 percent the number of fuzzes in the case when the yarn guide was used.

EXAMPLE 4

The apparatus employed in this example had a yarn texturing jet device of the type as shown in FIG. 3 and a yarn guide of the type as shown in FIGS. 8A and 8B. The diameter of the elongated axial channel 6 was 0.5 mm, that of the throat 9, 1.78 mm and that of the gas introducing opening 20, 2.78 mm. The yarn guide had a channel 21 of a width W of 1 mm, a depth h of 0.5 mm and a height H of the upstream end of 1 mm. The guide surface 18 had an inclination of 15°.

Figure 15:
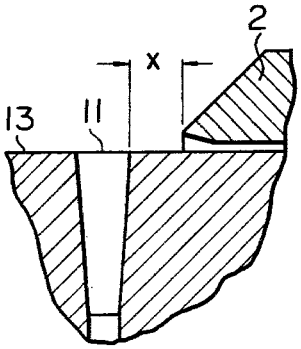

As shown in FIG. 15, the yarn guide was located on the exit end surface 13 of the jet device, in a condition such that the upstream end of the yarn guide was positioned at a distance of x mm from the periphery of the yarn outlet 11, as mentioned in Example 1 with reference to FIG. 14.

Using various yarn guides having an angle $\theta$ (FIG. 8B) between the downwardly tapered upstream end surface thereof and the exit end surface of the jet device, as shown in Table 1 below, a polyester yarn of 150 denier/72 filaments was textured.

Table 1

| Guide No. | $\theta$ |
|---|---|
| 1 | 90° |
| 2 | 75° |
| 3 | 60° |
| 4 | 45° |
| 5 | 0° |

Figure 10A:
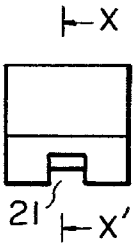
Figure 10B:
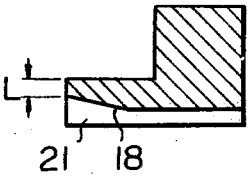

The yarn guide No. 5 having the $\theta$ of 0° was the one as shown in FIGS. 10A and 10B, wherein L is 0.5 mm.

The yarn was fed into the apparatus at a speed of 300 m/min, through a feed roller, and delivered by a delivery roller at a speed of 200 m/min. Fed into the jet device through the gas inlet pipe was pressurized air of 5 kg/cm$^2$ (G). The yarn was then taken up under a constant taking-up tension of 15 grams.

The number of undesirably large loops of the obtained yarn was measured using a photoelectric pick-up, as in Example 3. Then, the percentage of the then measured number of large loops was calculated with respect to that of the yarn obtained where the distance x is 1 mm.

Figure 17:
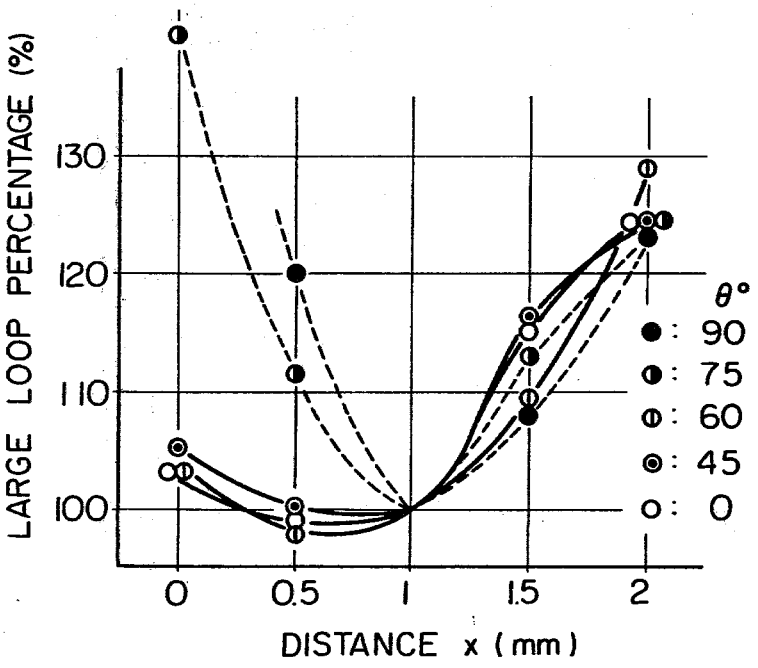
FIG. 17 is a graph showing the relationship between the large loop percentage of the resulting yarn and the position of the yarn guide.

The obtained relationships between the distance x and the percentage of the number of large loops are shown in FIG. 17, with respect to the respective angles $\theta$.

EXAMPLE 5

On a yarn texturing jet device of the type as shown in FIG. 3, wherein the elongated axial channel 6 had a diameter of 0.51 mm, the throat 9 had a diameter of 1.78 mm and the gas introducing bore 20 had a diameter of 2.78 mm, yarn texturing was carried out using the following baffles and yarn guides.

A. A baffle plate as disclosed in U.S. Pat. No. 3,835,510.

B. A cylindrical baffle as disclosed in U.S. Pat. No. 3,881,231.

C. A yarn guide as described in Example 4, wherein $\theta$ was 60° and x was 0.5 mm.

The baffle plate was disposed at a distance of 2 mm from the yarn outlet of the jet device with an inclination of 3° with respect to the exit end surface of the jet device. In turn, the cylindrical baffle was disposed so that the baffle crossed the center-line of the exit orifice of the jet device and protruded from the center-line by 2 mm. The diameter of the cylindrical baffle was 25.4 mm.

A polyester yarn of 150 denier/72 filaments which had been wetted with waterdrops was fed into the jet device at a speed of 300 m/min, through a feed roller, while introducing pressurized air of 5 kg/cm$^2$ (G) through the gas inlet pipe, and delivered by a delivery roller at a speed of 222 m/min. The yarn was then taken-up on a take-up device at a speed of 233 m/min and the taking-up tension was measured.

The amount of the air blown out of the yarn outlet of the jet device was 140 N l/min (normal liter/minute).

The measured taking-up tensions were as follows.

A. Where the baffle plate was used, 9.5 g

B. Where the cylindrical baffle was used, 12 g

C. Where the yarn guide was used, 17.5 g

Among the above, the yarn obtained using the cylindrical baffle had many undesirably large loops and, thus, the quality of this yarn was inferior to the others.

EXAMPLE 6

The procedure as described in Example 5 was repeated using the yarn guide and the baffle, except that the throat 9 of the exit orifice of the jet device had a diameter of 1.4 mm. The amount of the air blown out of the yarn outlet of the jet device was 97 N l/min (normal liter/minute).

The taking-up tensions of the respective yarns were 9.5 g in the case of using the yarn guide and 5 g in the case of using the baffle plate. The latter was, thus, poor in resistance to elongation.

The number of fuzzes measured on the yarn obtained using the yarn guide was nearly equal to that of the yarn obtained in Example 5 using the baffle plate. Thus, if the taking-up tension and the number of fuzzes of the yarn obtained in this example using the yarn guide are compared with those of the yarn obtained in Example 5 using the baffle plate, it is clearly proved that the apparatus of the invention can achieve a 30% saving of the pressurized gas, as compared with the apparatus disclosed in U.S. Pat. No. 3,835,510, from which yarns of approximately equal quality can be obtained.

EXAMPLE 7

A yarn texturing jet device of the type as shown in FIG. 4 was employed. The diameter of the yarn passage of the needle 7 was 0.3 mm and that of the throat 9 was 1.5 mm. The needle 7 had an inclination of 45° with respect to the longitudinal axis of the gas passage.

Figure 9A:
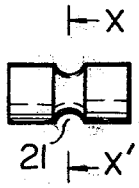
Figure 9B:
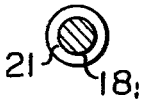

Two yarn guides of the type as shown in FIGS. 9A and 9B were located on the exit end surface of the jet device in parallel. The yarn guides had a diameter of 1.6 mm in the thin portion and that of 2.3 mm in the thick portion. One of the yarn guides was positioned such that the periphery of the thinnest portion facing the flow gas was at a distance of 0.5 mm from the periphery of the yarn outlet 11 of the jet device and the other was positioned at an interval of 1.7 mm from said one yarn guide.

Using this apparatus, a polyester yarn of 150 denier/72 filaments was textured. The yarn which had been wetted with waterdrops was fed into the apparatus at a speed of 200 m/min through a feed roller and delivered by a delivery roller at a speed of 143 m/min. Pressurized air of 6 kg/cm$^2$ (G) was fed into the jet device through the gas inlet pipe. Then, the yarn was taken up under a taking-up tension of 10 grams. The take-up speed was 153 m/min.

For comparison, the above procedure was repeated using no yarn guide. The take-up speed was 158 m/min where the yarn was taken up under a taking-up tension of 10 grams. On the other hand, the taking-up tension was 8 grams where the yarn was taken up at a speed of 153 m/min. The number of fuzzes of the yarn obtained using no yarn guide was 95 percent of the number of fuzzes of the yarn obtained using the yarn guide, when measured in the same manner as in Example 3.

What we claim is:

1. In a yarn texturing apparatus for producing a multifilament yarn containing complex interfilament entanglement comprising a housing having inlet and outlet ends connected by a yarn passage, a turbulence section in the yarn passage, an exit orifice constituting the yarn outlet and communicating with the turbulence section, and means for introducing pressurized gas into the yarn passage, whereby a multifilament yarn is subjected to an action of the turbulence of the pressurized gas in the turbulence section and, thereafter, is blown out of the exit orifice together with the pressurized gas, the improvement comprising: a yarn guide for separating said blown filament yarn from said blown gas while guiding said yarn along a guide surface of said yarn guide in a direction approximately perpendicular to the flow direction of said blown gas immediately after the filament yarn comes out of the yarn outlet is provided, outside of said housing and in the proximity of the exit end of said exit orifice, in a condition such that said yarn guide does not cross the center-line of said exit orifice, said guide surface of said yarn guide facing the yarn outlet end surface of said housing and one end of said yarn guide facing the flow of said blown gas at a distance of 0 to 8 mm. from the periphery of said yarn outlet.

2. An apparatus according to claim 1, wherein one end of said yarn guide facing the flow of said blown gas has a tapered surface gradually leaving along the flow direction of said blown gas.

3. An apparatus according to claim 2, wherein said tapered surface is a plain surface and the angle between said plain surface and a surface parallel to the yarn outlet end surface is from 0° to 60°.

4. An apparatus according to claim 2, wherein said tapered surface is a columnar surface.

5. An apparatus according to claim 1, further comprising means for adjusting the position of said yarn guide in the direction perpendicular to the flow direction of said blown gas.

6. An apparatus according to claim 1, wherein said distance is 0.5 to 3.5 mm.

7. An apparatus according to claim 1, further comprising means for shifting said yarn guide reciprocally from a position in the proximity of the exit end of said exit orifice to a position far from said exit orifice.

8. An apparatus according to claim 1, wherein said yarn guide is in block shape.

9. An apparatus according to claim 1, wherein said yarn guide is in the shape of a pin having a circular cross-section.

* * * * *